US005906305A

United States Patent [19]

Knorr

[11] Patent Number: 5,906,305

[45] Date of Patent: May 25, 1999

[54] APPARATUS FOR THE CORRECTIVE POSITIONING OF A TRAVELLING WEB AT RIGHT ANGLES TO THE DIRECTION OF TRAVEL

[75] Inventor: Andreas Knorr, Nürnberg, Germany

[73] Assignee: BHS Corrugated Maschinen- und Anlagenbau GmbH, Weiherhammer, Germany

[21] Appl. No.: 08/838,032

[22] Filed: Apr. 22, 1997

[30] Foreign Application Priority Data

Apr. 27, 1996 [DE] Germany ..... 196 16 945

[51] Int. Cl.[6] ..... B23Q 15/00

[52] U.S. Cl. ..... 226/21; 242/615.21; 198/807

[58] Field of Search ..... 226/21, 22, 23, 226/180; 242/615.21; 198/807

[56] References Cited

U.S. PATENT DOCUMENTS

| | | |
|---|---|---|
| 3,107,036 | 10/1963 | Richards et al. . |
| 3,380,637 | 4/1968 | Knapp . |
| 3,435,693 | 4/1969 | Wright et al. . |
| 3,436,002 | 4/1969 | Racine . |
| 4,243,167 | 1/1981 | Sander . |
| 4,552,295 | 11/1985 | Smith et al. . |
| 5,226,577 | 7/1993 | Kohler . |
| 5,397,043 | 3/1995 | Blanding . |
| 5,562,038 | 10/1996 | Bierbaum et al. . |
| 5,653,331 | 8/1997 | Graf . |

FOREIGN PATENT DOCUMENTS

| | | | |
|---|---|---|---|
| 0 387 242 | 9/1990 | European Pat. Off. . | |
| 1 169 275 | 4/1964 | Germany . | |
| 130567 | 12/1978 | Germany | 198/807 |
| 30 35 798 | 4/1982 | Germany . | |
| 85 04 177 | 5/1985 | Germany . | |
| 43 35 747 | 6/1995 | Germany . | |
| 195 17 960 | 11/1995 | Germany . | |
| 1082513 | 9/1967 | United Kingdom | 226/21 |

*Primary Examiner*—Donald P. Walsh
*Assistant Examiner*—William A. Rivera
*Attorney, Agent, or Firm*—Browdy and Neimark

[57] ABSTRACT

An apparatus for the corrective positioning of a travelling web at right angles to the direction of travel comprises a tilting roll over which the web to be positioned is guided. At both ends of the roll, provision is made for rotary bearings, the respective opposite bearing member of which is articulated to a pendulum joint element. These two pendulum joints define an oblique tilting axis, which intersects the axis of rotation in the center of gravity of the roll and runs in a plane which cooperates with a vertical plane situated at right angles to the direction of travel to enclose an acute angle.

15 Claims, 7 Drawing Sheets

"Lb"
"Lb1"
"Lb2"
"N"
"Q"
"A"
"M"
"ω"
R
S
W
1
2
3
4
5
6
6'
7
8
9
10
11
12
13
14
15
18
19

"N"
"M"
Q
R
S
W
A
1
2
3
4
5
6
6'
7
8
9
10
11
12
14
15
16
17
18
19
III
III

FIG. 5.1
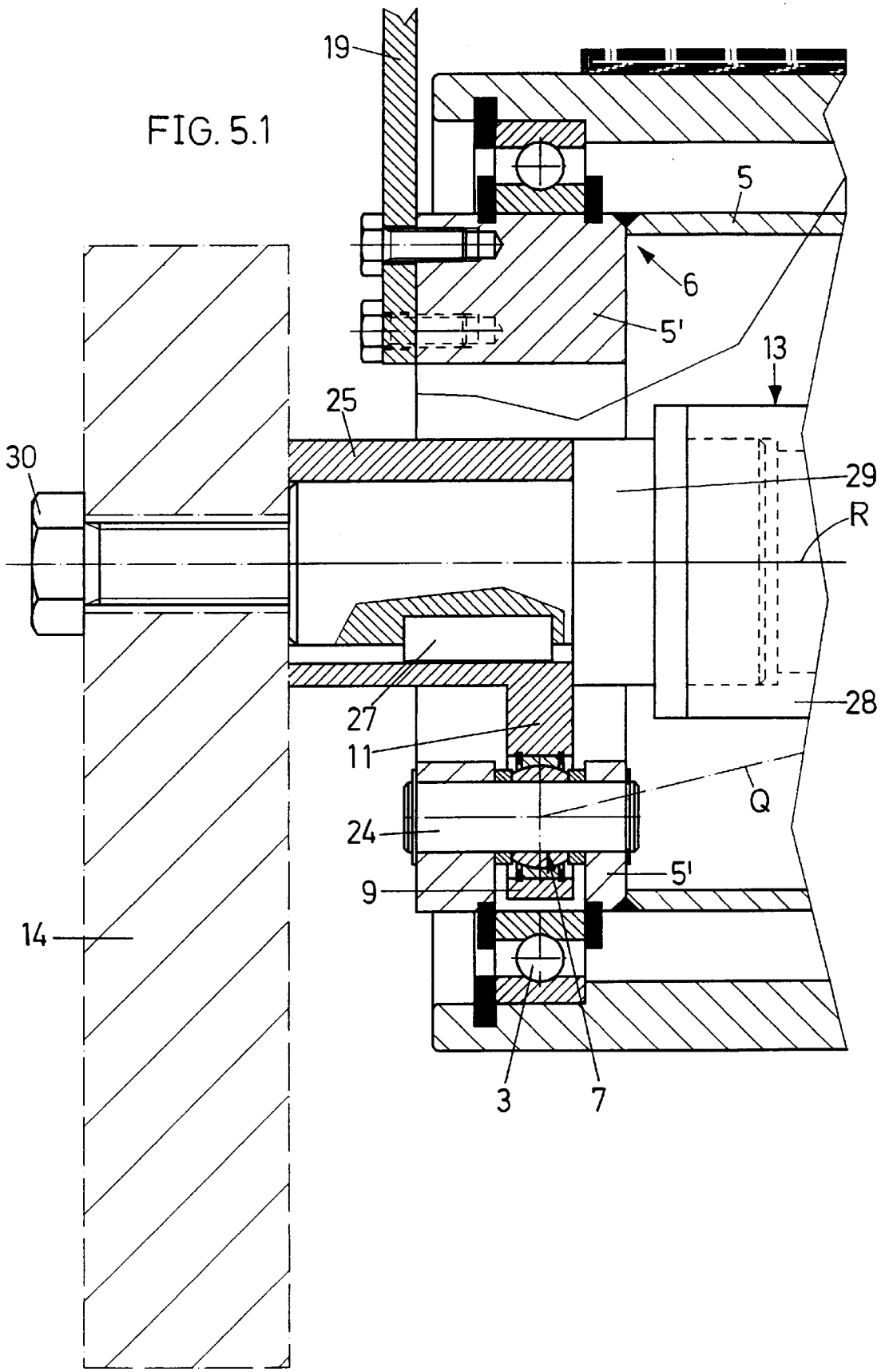

"Lw"
"Lw/2"
"Lb"
"Lb/2"
IX
Fr
X

APPARATUS FOR THE CORRECTIVE POSITIONING OF A TRAVELLING WEB AT RIGHT ANGLES TO THE DIRECTION OF TRAVEL

BACKGROUND OF THE INVENTION

1. Field of the Invention

The invention relates to an apparatus for the corrective positioning of a travelling sheet or web at right angles to the direction of travel. The term "travelling sheet or web" is to be understood generally as any kind of product that is processed as a semi-finished product or, in an intermediate manufacturing stage, as sheet material, such as plastic sheet, plastic bags, newspapers, imitation leather, paper webs in the case of corrugated board production etc. On the other hand, this term is also meant to comprise continuously circulating belts utilized for instance as so-called "wire cloth" or "felt belts" in paper machines or as conveyor belts in materials-handling technology.

2. Background Art

The sheets as well as belts of the generic type tend to escape laterally during machine operation. For this to be prevented, so-called "sheet guiders" are employed, which ensure a clearly defined position of the running sheets. In this connection, three substantial sources of errors in the running of a sheet are to be cited:

- static errors conditioned by badly adjusted deflection rolls, laterally misaligned sheet supply rolls etc. in a sheet-processing machine
- dynamic errors conditioned by wavy edges, wobbling rolls, humidity, temperature fluctuations etc.
- tension errors provoked by irregular distribution of tension over the cross-section of the sheet.

Various embodiments of so-called sheet guiders are known from the prior art. For instance, so-called rotating frames are used, in which two guide rolls that are parallel to each other at a distance in the direction of sheet travel are disposed in a frame which is rotatable about a vertical axis by a corresponding servo component for instance in the form of a pneumatic cylinder. In this way, the two guide rolls can be inclined slightly relative to the direction of travel on a horizontal plane so that a corresponding transverse displacement is conferred to the sheet running over the guide rolls. The transverse position of the sheet can be corrected permanently by adjustment of the rotating frame.

According to further known prior art, a sheet guiding system is used for the guide control of continuous belts such as conveyor belts and wire cloth belts of varying materials, for instance plastic material, rubber, metal fabric, textile fabric, etc., making use of a sheet-guiding roller having an actuator, a thrust bearing, and a mechanical tracing system in the form of a roller lever. On one side the sheet guiding roller lodges pivotably in the thrust bearing by way of its bearing pins, while rotarily sliding in a combination bearing on the other side. The combination bearing is again mounted on an actuator which is disposed laterally of the sheet to be guided and by means of which the sheet-guiding roller, on the other side, is pivotal about the thrust bearing that forms its pivot. The pivoting motion is controlled by the edge of the sheet being mechanically traced.

Both prior art sheet guiders have the drawback of fundamentally needing active control by an edge tracer and a servo unit.

This also applies to the system disclosed by DE 195 17 960 A1 for the travel control of a belt in a corrugated-board machine for so-called "single-face corrugated board". In this case, a continuous belt runs over a plurality of rolls, one of which is rotatably run on a support shaft. One end of this support shaft is pivotably housed in an articulation point, while its opposite end is housed in a ball-and-socket joint which is displaceable by means of a spindle drive at right angles to the direction of rotation of the roll. The belt travel is again traced by a detecting device and the axis of rotation of the roll is adjusted by operation of the actuator in such a way that warping of the belt is precluded.

The professional paper "Wochenblatt für Papierfabrikation", February 1965, page 94, discloses an automatic guide roll—called "servo roll"—for wire cloth and felt belts in paper machines, which does not need a position sensor for the belt to be guided nor any actively operating servo control component. Rather, the guide roll compensates any escape motion of the belt to be guided by tilting motion, returning same into its desired position.

To this end, the guide roll is equipped with a special tilting bearing system. The latter comprises a stationary central pipe, which centrally exhibits an approximately perpendicular bolt. This bolt constitutes a tilting axis about which a shorter piece of pipe may reciprocate in the horizontal. This piece of pipe has a ball bearing at each of its ends, about which can rotate an exterior sleeve pipe of glass fiber reinforced polyester. This sleeve pipe is the actual guide roll.

By it being specifically profiled to have a slightly conical taper at the end and owing to the explained tilting bearing arrangement, the guide roll will incline and will slightly right simultaneously when the belt to be guided escapes to one side. As a result, the belt is guided back to the middle and the guide roll takes a position precisely perpendicular to the direction of travel.

A drawback of the prior art guide roll resides in the fact that the tilting bearing system is comparatively hidden inside the sleeve pipe, therefore being difficult to mount. Moreover, the force resulting from the described bearing behavior concentrates on the center of the central pipe to be borne so that for increased working widths, the roll must have very great diameters for reasons of stability. Furthermore, this guide roll does not offer any possibility of additionally providing an active positioning system, if the reaction velocity of the automatic positioning system does not comply with the respective application.

SUMMARY OF THE INVENTION

Proceeding from the described prior art and the problems occurring, it is the object of the invention to specify an apparatus for the corrective positioning of a travelling sheet at right angles to the direction of travel which works automatically, having high sensitivity of reaction, but which can also be coupled with an active positioning system and is accompanied with little mounting requirements.

This object is attained by the following features. At least one tilting roll is provided, over which the web, to be correctively positioned transversely, is guided at an angle of contact, and which has a rotating sleeve. At two symmetrical places of the sleeve pipe, in particular at the two ends of the roll, the sleeve is supported, by way of two rotary bearings, on an internal opposite bearing member non-rotatable relative to the rotary axis R of the roll sleeve. Directly or by means of a lever system, this opposite bearing member, which may for instance be a pipe or a rod, is again symmetrically articulated by way of pendulum-joint elements, the pendulum-joint elements being stationarily disposed diametrically opposite to each other at a radial distance from the axis of rotation. The two pendulum-joint elements thus define an oblique tilting axis for the tilting roll, the tilting axis intersecting the axis of rotation in the center of gravity of the roll, forming an acute angle, and running in a plane that cooperates with a vertical plane situated at right angles to the direction of travel to enclose an acute angle opening in the direction of travel. The plane receiving the tilting axis is tilted toward the direction of travel, which is an important feature of the function of sheet guidance. When several rolls are used, the tilting axis intersects the plane spanned by the axes of rotation of the rolls in the latter's common center of gravity.

The axis of symmetry of the continuous opposite bearing member coincides with the axis of rotation of the roll or—in the case of several rolls—lies on the plane formed by the axes of the rolls and is parallel to the axes of the rolls.

By reason of the specified construction, the tilting roll is in an indifferent equilibrium as long as the web to be guided runs symmetrically over the tilting roll. As soon as it leaves its desired position, the tilting roll is loaded irregularly and tilts about the oblique tilting axis so that it is deflected out of its horizontal position and the belt is returned into its position of equilibrium. As found by testing in practice, the tilting roll will duck on the side toward which the web to be guided escapes in the transverse direction. Because of this tilting, the web, as it were, ascends the tilting roll so that it is again guided back into the middle and the tilting roll is straight again.

In the sheet guidance according to the invention, it is of advantage that the rotary bearings are at both ends of the roll so that the mounting requirements are considerably reduced. Moreover, the kind of "double tilting bearing system" according to the invention by two diametrically opposed pendulum joint elements for the definition of an oblique tilting axis provides for highly efficient, automatic sheet guidance. The latter is designed such that an active positioning system can be coupled with a conventional position sensor for the transverse position of the web to be guided, with a control device combined with the position sensor and with a servo component controlled by the control device. The servo component can have direct access to the opposite bearing member for the tilting adjustment of the tilting roll, this opposite bearing member being situated in the vicinity of the ends of the roll—i.e. virtually freely accessible. This is an important criterion as compared with the "servo roll" explained above.

Attention is drawn to the fact that the non-rotary assembly of the opposite bearing member and, if required, of a lever system is a rigid structure serving as a support for the one or several tilting rolls. This structure, rigid in itself, is connected with the tilting roll by the specified pendulum joint elements.

Further features, details and advantages of the invention will become apparent from the subclaims and the ensuing description of exemplary embodiments of the subject matter of the invention, taken in conjunction with the drawing.

DESCRIPTION OF THE PREFERRED EMBODIMENTS

The basic structure and the principle of the apparatus according to the invention for the corrective positioning of a travelling web will be explained, taken in conjunction with FIGS. 1, 2 and 3. A tilting roll 1 is provided with a roll sleeve 2, each lengthwise end of which is equipped with rotary bearings in the form of ball bearings 3, 4. These ball bearings 3, 4 can take up axial forces in addition to radial forces.

Figure 1:
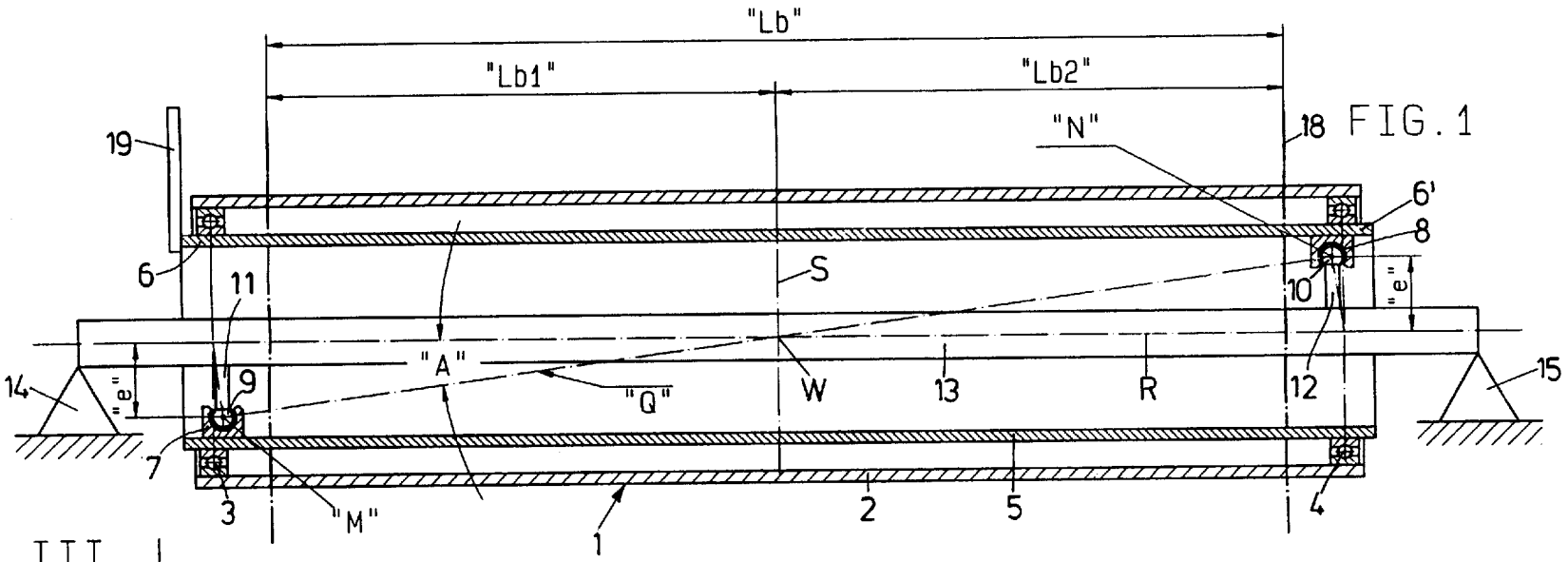
FIGS. 1 and 2 are diagrammatical views of axial sections of tilting rolls, showing two different kinds of roll-bearing systems.
Figure 2:
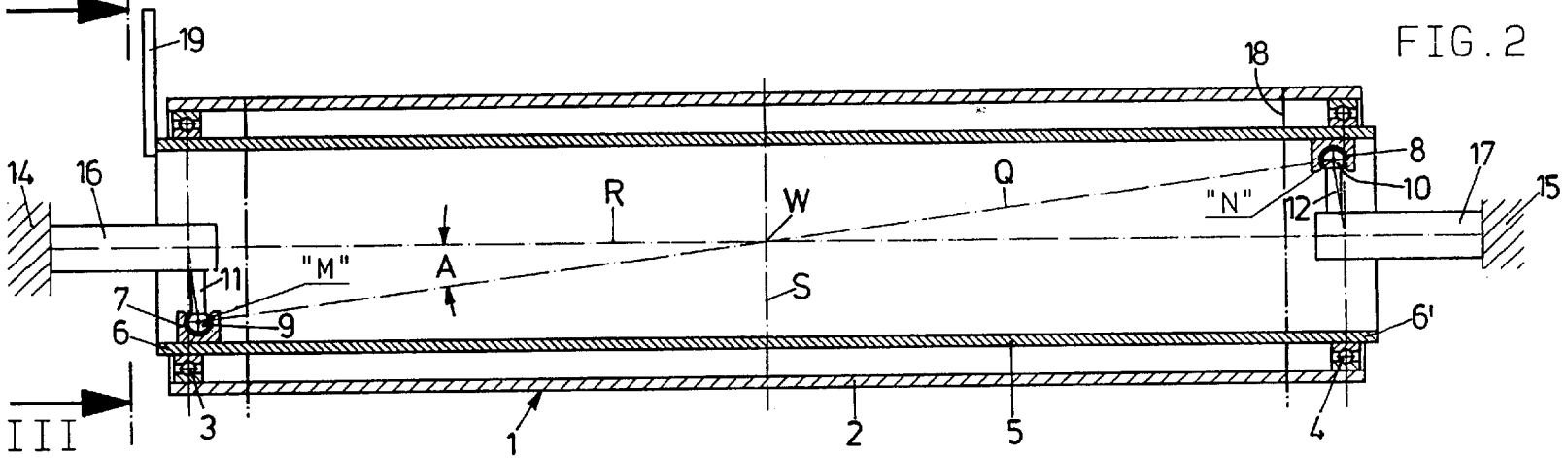
Figure 3:
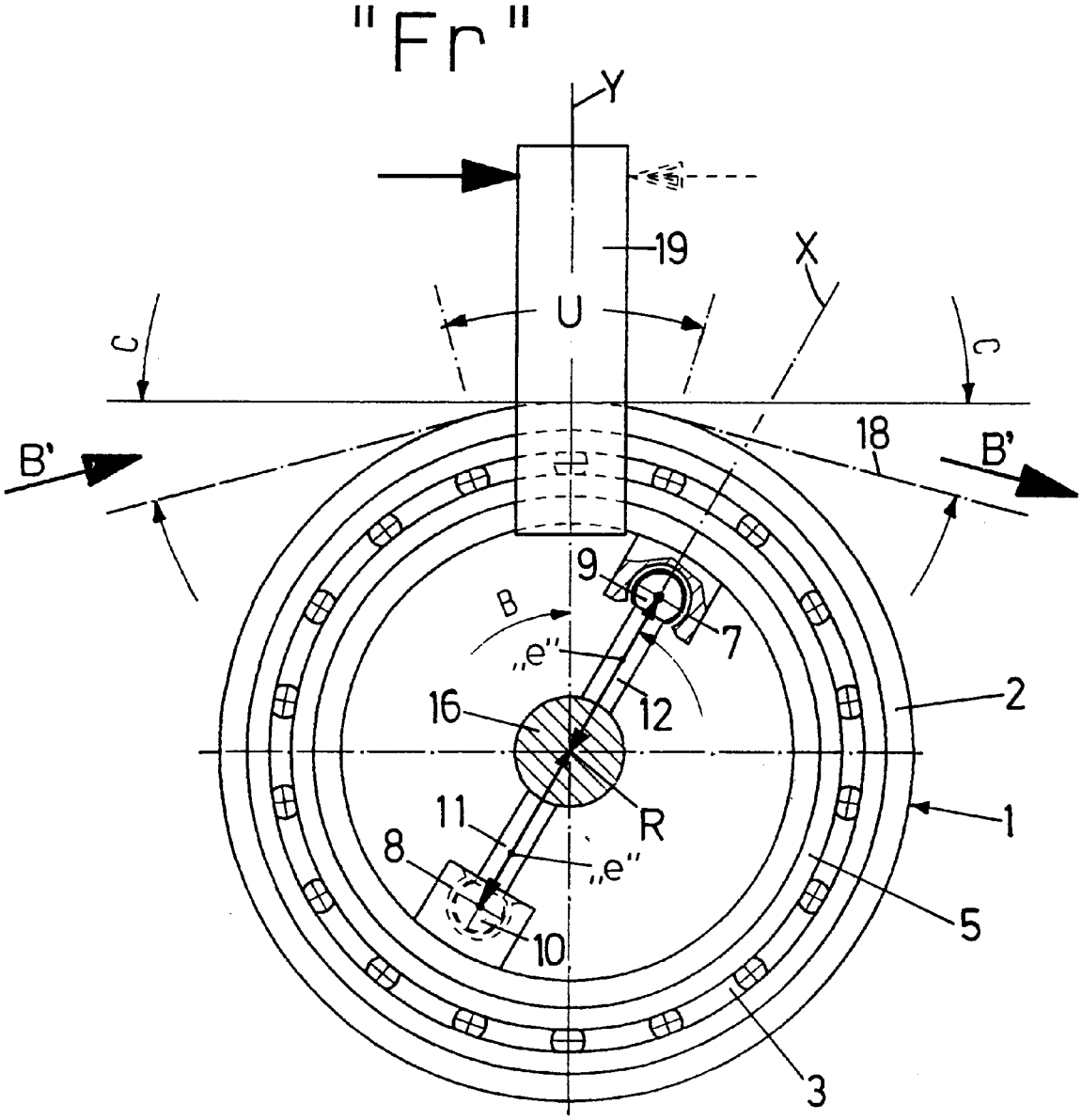
FIG. 3 is a lateral view of the tilting roll seen from the direction of arrow III according to FIG. 2.

In the embodiments according to FIGS. 1 to 3, the opposite bearing member, stationary in motion of rotation, for the ball bearings 3,4 is formed by a common continuous bearing pipe 5, the ends 6, 6' of which are articulated each to a pendulum joint element symbolically outlined and functionally designed as a ball-and-socket joint 7, 8. The stationary opposite bearing member 9, 10 of the two ball-and-socket joints 7, 8 is located on radial stanchions 11, 12 which are again disposed on a main bearing stationary on the machine. In the embodiment according to FIG. 1, the main bearing is a continuous axle 13 mounted on two bearings 14, 15, diagrammatically outlined, of the machine frame.

In the embodiment of FIGS. 2 and 3, the main bearing is formed by two coaxially disposed axle stubs 16, 17 fixed to the bearings 14, 15.

As seen in FIG. 3, the two radial stanchions 11, 12 run in diametrically opposed directions and are inclined by an angle B relative to the vertical. Their radial distance "e" from the axis of rotation R of the tilting roll 1 can amount to 30 to 100 mm. The greater "e", the higher the sensitivity of the automatic guidance to be described in detail below. The two central points M and N of the ball-and-socket joints 7, 8 forming the pendulum joint elements define an oblique tilting axis Q which intersects the axis of rotation R in the center of gravity W of the roll, forming an acute angle A, and runs in a plane X which cooperates with a vertical plane Y extending at right angles to the direction of travel B' to enclose the mentioned acute angle B which opens in the direction of travel B'. The plane X is tilted in the direction of travel B' as seen in FIG. 3.

As further seen in FIG. 3, the web 18, which is to be guided in its transverse position, is led over the tilting roll 1 at an identical run-on and run-off angle C so that an angle of contact U results, equalling 2 C. In the balanced condition of equilibrium as seen in FIGS. 1 to 3, the web 18 (dot-dashed in FIGS. 1 and 2) is arranged centrally so that the partial widths Lb1 and Lb2 of the web width Lb are identical on the left and the right of the plane of symmetry S.

The automatic sheet-guiding function of the tilting roll 1 is explained roughly in the following:

If the web 18 escapes to the left from the position of equilibrium seen in FIGS. 1 to 3 (Lb1>Lb2), the left end of the roll would move downward, owing to the clockwise rotation of the end 6 of the bearing pipe 5 about the bearing point M, and simultaneously, the right end of the roll would rotate upward clockwise about the bearing point N. The tilting roll 1 takes an inclined position which causes the web 18 to return to the condition of equilibrium (Lb1=Lb2), as a result of which the tilting roll 1 is again moved in a reversed sense of rotation into the horizontal position shown in FIGS. 2 and 3. Automatic guidance of the transverse position of the web is attained by the aid of the tilting roll 1, the optimal course being determined by the angles A, B and C to which applies: A approximately equal to 2° to 10°, B approximately equal to 30° and C approximately equal to 15°. Owing to the relation U=2C, there will be an angle of contact U of approximately 30°. Other angles of contact, such as for instance 180°, are conceivable too.

As further seen in FIGS. 1 to 3, a lever arm 19 can be fixed to the end 6 of the bearing pipe 5, serving for an active mechanism (to be explained below) of control of the transverse web position to engage.

Figure 4:
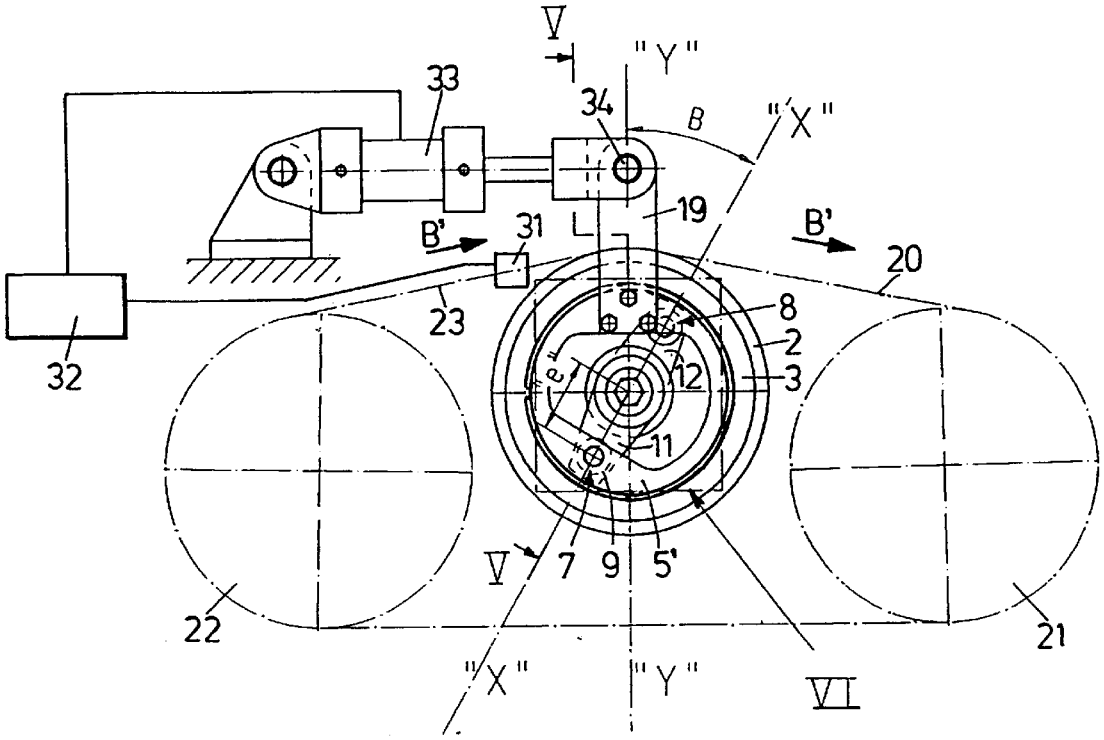
FIG. 4 is an axial lateral view of a concrete, constructive embodiment of the tilting roll diagrammatically outlined in FIG. 1.
Figure 5:
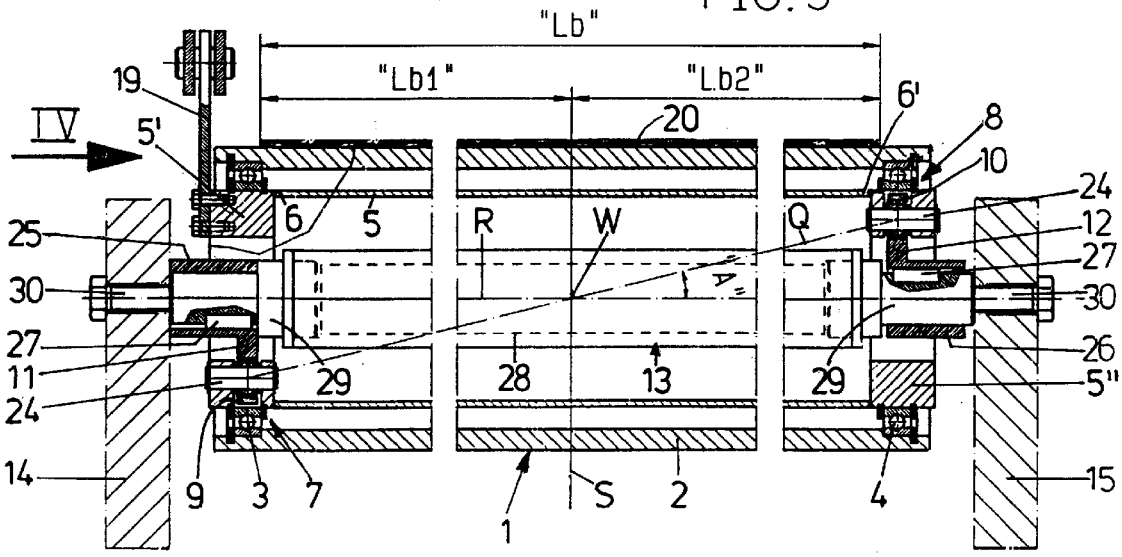
FIG. 5 is an axial sectional view of the tilting roll on the section line V—V of FIG. 4, FIG. 5.1 is a cut from FIG. 5 of an end of the roll on an enlarged scale.
Figure 6:
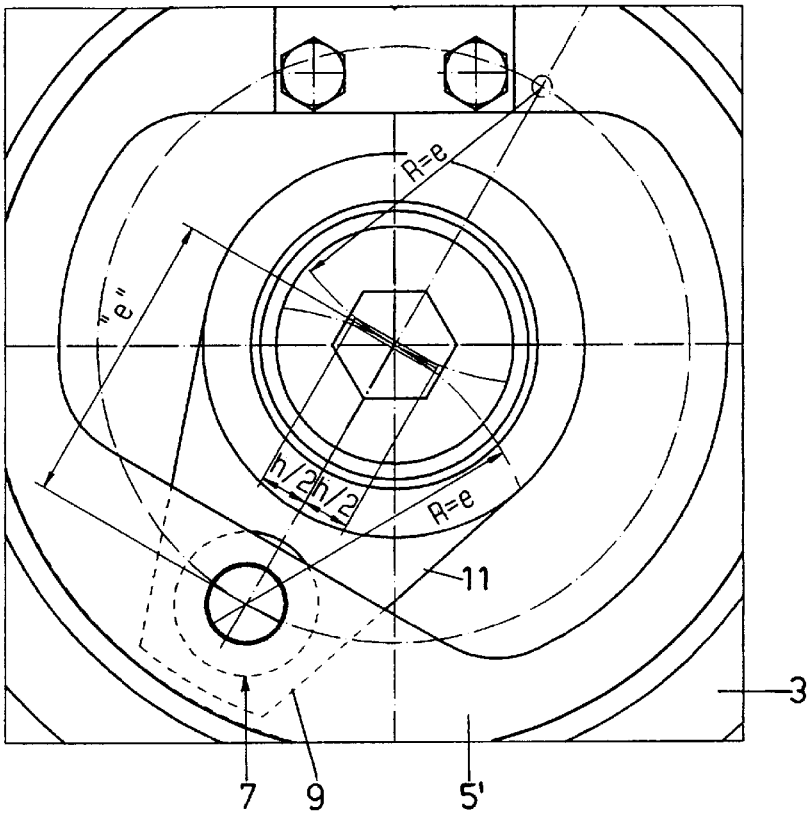
FIG. 6 is a lateral view of the detail VI of FIG. 4 on an enlarged scale.

FIGS. 4 to 6 illustrate a concrete, constructive embodiment of the tilting roll diagrammatically outlined in FIG. 1, FIG. 4 showing by dot-dashed lines that the tilting roll 1 serves for the guidance of the transverse postion of a continuous belt 20, which may for instance be a pressing belt in a corrugated board machine. The belt is guided around two deflection pulleys 21, 22. The upper strand 23 of the belt 20 is guided over the tilting roll 1.

In FIGS. 4 to 6, the components already specified in FIG. 1 have identical reference numerals and need no renewed explanation. It must be added that the bearing pipe 5 is completed at its two ends 6, 6' by bearing axis rings 5', 5", each serving as an opposite bearing member for the rotary bearings 3, 4. Furthermore, the articulated bearings 7, 8 are ball-and-socket joints, therefore being rotatable about all the three axes of the coordinate system. As illustrated in FIG. 5.1 on an enlarged scale, the axes of the articulated bearings coincide with the axes of the bolts 24. The radial stanchions 11, 12 are mounted on a sleeve member 25, 26 which resides non-rotatably (arrest 27) on the axle 13. The latter comprises a central pipe 28 which takes almost the entire length of the tilting roll 1 and into the ends of which cylindrical, stepped pins 29 are inserted, each of which receiving the sleeve members 25, 26. On the side of its end, the axle 13 is screwed to the bearing 14, 15 (screws 30).

The apparatus seen in FIGS. 4 to 6 is further provided with an active positioning system which acts on the lever aim 19. This active positioning system comprises a position sensor 31, which is disposed upstream of the tilting roll 1 in the direction of travel B', and which may be for instance an electro-optical or pneumatic edge feeler as known from prior art. The position sensor 31 is connected with a controlling equipment 32 which processes the measuring signals of the position sensor 31 and, on this basis, controls a drive 33, for instance a mechanical spindle or a pneumatic cylinder coupled with the lever arm 19 by way of a joint 34. If the belt 20 leaves its desired transverse position (Lb1=Lb2 in FIG. 5), this is immediately detected by the position sensor 31, and the pneumatic cylinder drive 33 is triggered by the controlling equipment 32 in such a way that the bearing axis ring 5' is pivoted by a certain angle about the ball-and-socket joint 7. Due to the coupling by means of the bearing pipe 5, this pivoting motion conditions a reversed pivoting motion of the second bearing axis ring 5" about the ball-and-socket joint 8, which causes the inclined position of the tilting roll 1 described in connection with FIGS. 1 to 3. This again leads to the belt 20 being moved back into the desired position.

Figure 7:
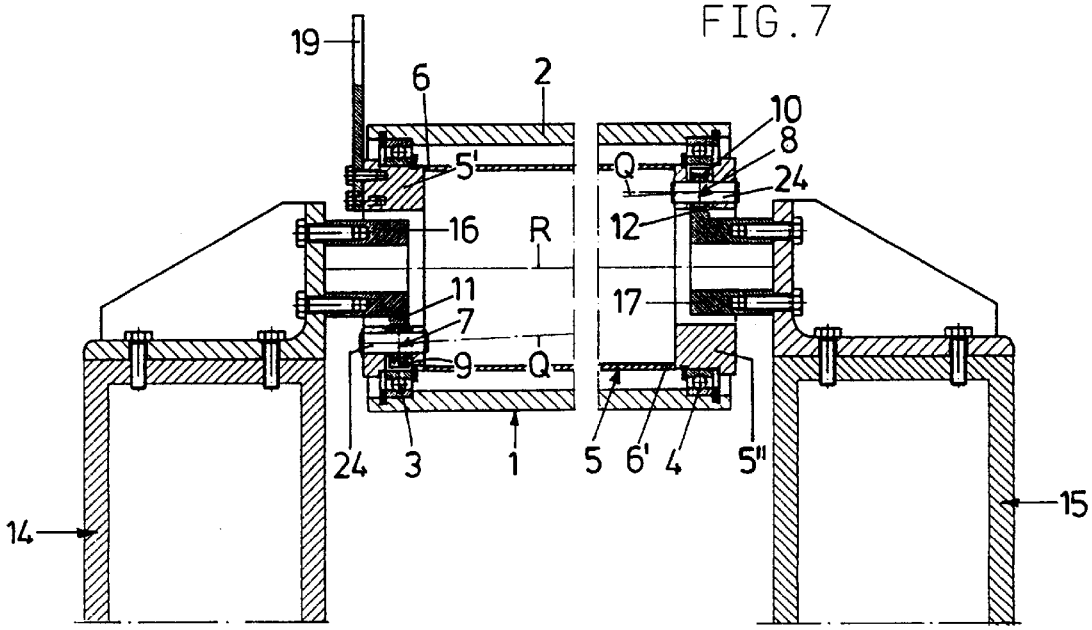
FIG. 7 is an axial sectional view of a concrete constructive embodiment of the tilting roll diagrammatically outlined in FIG. 2.

The embodiment of FIG. 7 differs from the embodiment according to FIGS. 4 to 6 substantially only in the design of the main bearing. By analogy to FIGS. 2 and 3, this main bearing is formed by axle stubs 16, 17 screwed to the bearing 14, 15 and on which the radial stanchions 11, 12 for the pendulum-joint elements 7, 8 are integrally injection-molded. Otherwise, identical constructive parts have identical reference numerals and need no renewed explanation.

Figures 8, 9, 10:
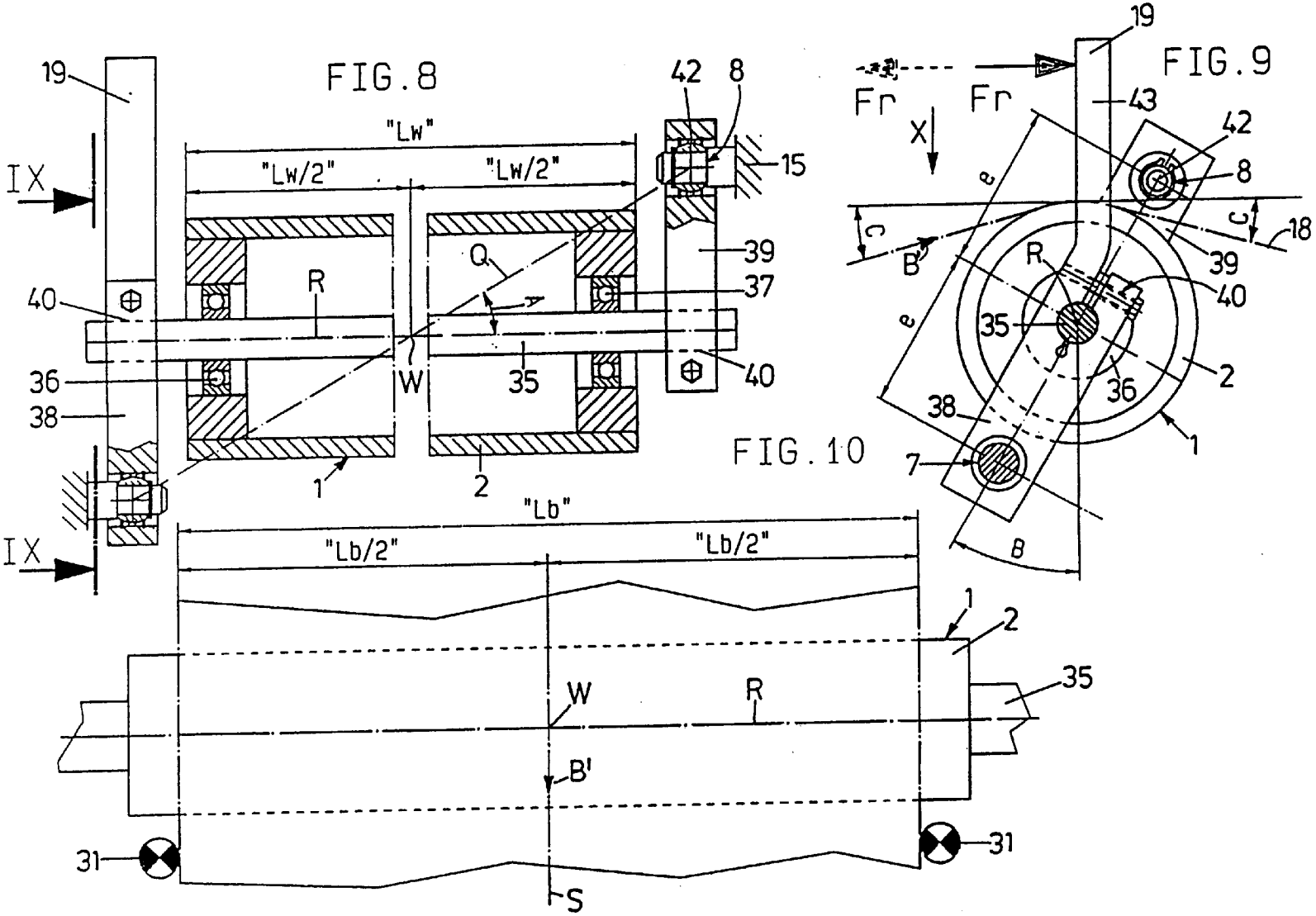
FIG. 8 is a longitudinal sectional view through another embodiment of a tilting roll.
FIG. 9 is a sectional view of the tilting roll along the sectional plane IX—IX of FIG. 8.
FIG. 10 is a plan view of this tilting roll seen from the direction of arrow X of FIG. 9, and FIGS. 11 and 12 are diagrammatical views of tilting rolls embedded in a tilting frame.

An embodiment of identical constructional principle of a web positioning system according to the invention is illustrated in FIGS. 8 to 10. In this case the roll sleeve 2 of the tilting roll 1 is rotationally mounted via the ball bearings 36, 37 on a continuous rotary bearing axis 35 as a bearing axis member. At both ends this rotary bearing axis 35 is provided with holding stanchions 38, 39 projecting radially in directions facing away from each other diametrically, the holding stanchions 38, 39 being tightly joined to the rigid rotary bearing axis 35 by means of the clamp fitting 40 seen in FIG. 9. At the end opposite to the clamp fitting 40, each holding stanchion 38, 39 is supported by way of a ball-and-socket joint 7, 8 as a pendulum-joint element, the stationary opposite bearing member 41, 42 of which is fixed to a bearing 14, 15.

As roughly outlined in FIGS. 8 and 9, the first holding stanchion 38 is provided with a prolongation 43 working as a lever arm, on which may act a drive (not shown in detail) for the adjustment of the tilting roll 1 (driving power Fr). Of course, the construction seen in FIGS. 8 to 10, is also able to work automatically without any active positioning system, as explained in connection with FIGS. 1 to 3.

Which construction to choose for the respective application—an automatic or an externally controlled, active positioning system—depends on the desired quality of belt travel. With very strict tolerances for the lateral alignment, the belt guidance will be controlled by the lever 19. Automatic positioning is sufficient in case the lateral alignment of the belt is less important for the operation of the machine.

As seen in FIGS. 8 and 9, a completely normal series roll, for instance a paper or corrugated-board guide roll, can be retrofitted, and used as a corrective positioning roll, simply by the installation of two levers 38, 39 and two opposite bearings 7, 8.

Figure 11:
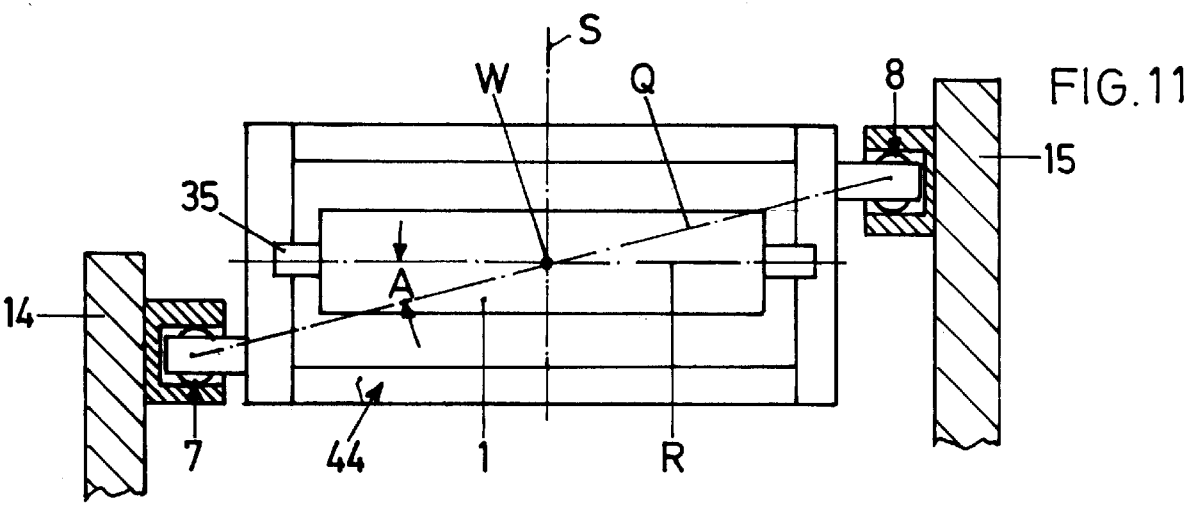

Functionally, the embodiment of FIG. 11 corresponds to that according to FIGS. 8 to 10. Only the rigid assembly consisting of the rotary bearing axis 35 and the holding stanchion 38, 39 is completed to form a frame 44. The two ball bearings 36, 37 are however disposed analogously to the embodiment mentioned above.

Figure 12:
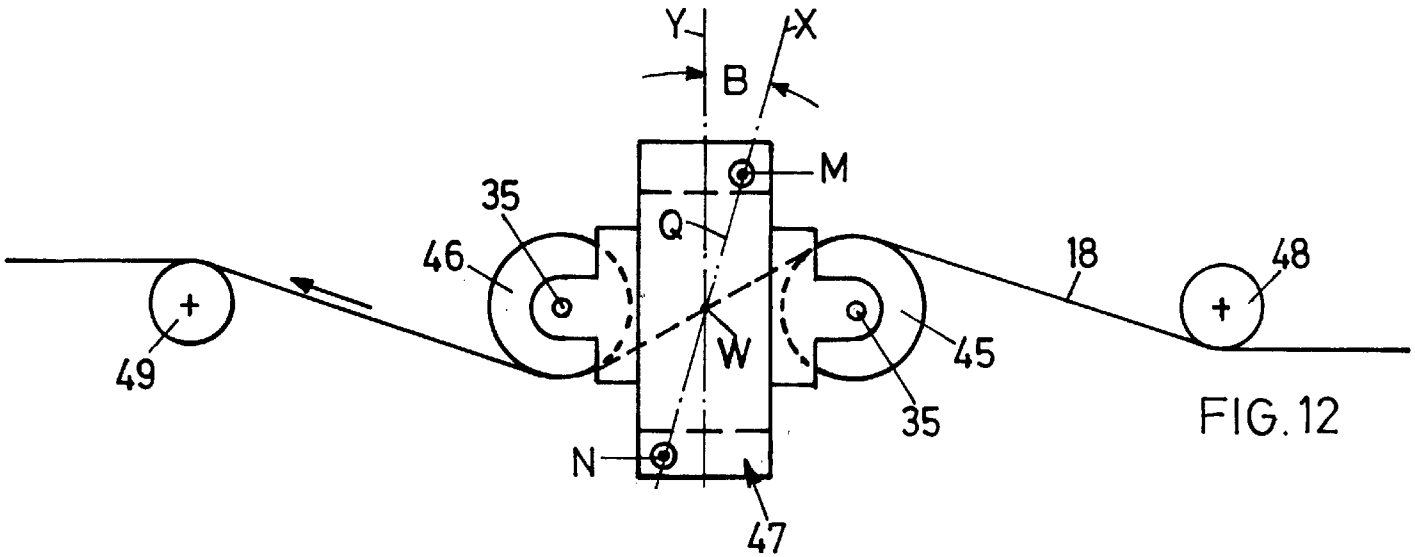

FIG. 12 illustrates a double-roll arrangement, in which two rolls 45, 46 disposed side by side parallel to, and at a distance from, each other are mounted in common on a tilting frame 47. By analogy to the frame 44, the latter is articulated by way of two ball bearings 36, 37. The tilting axis Q defined by them runs through the center of gravity W located between the two rolls 45, 46.

The tilting roll arrangement 47 is combined with guide rolls 48, 49 on the run-on and run-off side.

What is claimed is:

1. An apparatus for the corrective position of a travelling web (18, 20) at right angles to the direction of travel (B'), comprising at least one tilting roll (1, 45, 46)

over which the web (18, 20), to be correctively positioned transversely, is guided at an angle of contact (U), said at least one tilting roll having a rotating sleeve (2) and a sleeve pipe, said rotating sleeve (2) supported on said sleeve pipe by two rotary bearings, at two ends of the sleeve pipe, said sleeve pipe being (5, 5', 5", 35) non-rotatable relative to the axis of rotation (R) of the roll sleeve (2), said sleeve pipe (5, 5', 5", 35) being symmetrically articulated by pendulum-joint elements (7, 8), the pendulum-joint elements (7, 8) being stationarily disposed diametrically opposite to the at least one tilting roll (1) and at a radial distance from the axis of rotation (R), and are in common defining an oblique tilting axis (Q), which intersects the axis of rotation (R) in the center of gravity (W) of the at least one tilting roll, forming an acute angle (A), and which runs in a plane (X) that cooperates with a vertical plane (Y) situated at right angles to the direction of travel (B') to enclose an acute angle (B) thereby opening in the direction of travel (B').

2. An apparatus according to claim 1, wherein the angle (B) between the plane (X) and the vertical plane (Y) is approximately 30°.

3. An apparatus according to claim 1, wherein the angle of contact (U) is approximately 20 to 30°.

4. An apparatus according to claim 1, wherein the angle of intersection (A) of the tilting axis (Q) and the axis of rotation (R) is approximately 2° to 10°.

5. An apparatus according to claim 1, wherein a tilting axis of the at least one tilting roll (1), together with the roll sleeve (2), is rotationally supported on a common bearing pipe (5), the ends of which (6, 6') are articulated to pendulum joints in the form of ball-and-socket joints (7, 8).

6. An apparatus according to claim 1, wherein the pendulum joints (7, 8) are disposed on radial stanchions (11, 12), which stand out radially from stationary main bearings (13, 16, 17).

7. An apparatus according to claim 6, wherein the main bearings are formed by a stationary axle (13) running through the at least one tilting roll (1).

8. An apparatus according to claim 6, wherein the main bearings are formed by stationary axle stubs (16, 17), which reach from outside into the roll sleeve.

9. An apparatus according to claim 1, wherein the at least one tilting roll (1) is rotationally supported on a continuous rotary bearing axis (35) as a bearing axis member, the rotary bearing axis (35), at both ends, being provided with holding stanchions (38, 39), which stand out radially in directions facing away from each other diametrically, and which are articulated in stationary pendulum-joint elements (7, 8).

10. An apparatus according to claim 9, wherein the holding stanchions (38, 39) are part of a tilting frame (47).

11. An apparatus according to claim 1, wherein an active positioning system comprises a position sensor (31) for the transverse position of the web to be guided (18, 20), a controlling equipment (32) connected with the position sensor (31), and a servo component (33) controlled by the controlling equipment (32), the servo component (33) tilting the bearing-axis member (5, 5') about the tilting axis (Q) for the tilting adjustment of the tilting roll (1) and thus for the guidance of the web to be positioned.

12. An apparatus according to claim 1, wherein the sleeve pipe (5, 5', 5") is symmetrically articulated by the pendulum-joint elements (7, 8) directly.

13. An apparatus according to claim 12, wherein the entire, non-rotary assembly of the sleeve pipe (5, 5', 5") is tightly united to form a rigid unit.

14. An apparatus according to claim 1, wherein the sleeve pipe (35) is symmetrically articulated by way of the pendulum-joint elements (7, 8) by means of a lever system (38, 39; 44, 47).

15. An apparatus according to claim 14, wherein the entire non-rotary assembly of the sleeve pipe (35) and of the lever system (38, 39; 44, 47), which is located between and tiltingly supported on the pendulum-joint elements (7, 8) is tightly united to form a rigid unit.

* * * * *